United States Patent [19]

Cowden

[11] Patent Number: 4,552,382

[45] Date of Patent: Nov. 12, 1985

[54] BOOKHOLDER WITH MAGNIFIED VIEWING WINDOW

[76] Inventor: Mollie G. W. Cowden, 813 Caravan Cir., Austin, Tex. 78746

[21] Appl. No.: 517,210

[22] Filed: Jul. 25, 1983

[51] Int. Cl.[4] ..... B42D 9/00; B42D 3/00

[52] U.S. Cl. ..... 281/45; 281/42

[58] Field of Search ..... 281/42, 45, 46, 47

[56] References Cited

U.S. PATENT DOCUMENTS 1,642,384 9/1927 Pryor ..... 281/45
3,140,883 7/1964 Anthony ..... 281/42
4,159,836 7/1979 Tarr ..... 281/45

FOREIGN PATENT DOCUMENTS 443125 2/1936 United Kingdom ..... 281/45

*Primary Examiner*—Paul A. Bell
*Assistant Examiner*—Paul M. Heyrana, Sr.
*Attorney, Agent, or Firm*—Andrew S. Viger

[57] ABSTRACT

The disclosed bookholder incorporates a viewing window with either an integral or detachable magnification element that permits magnified viewing of the pages held beneath the viewing window.

1 Claim, 2 Drawing Figures

BOOKHOLDER WITH MAGNIFIED VIEWING WINDOW

BACKGROUND OF THE INVENTION

Numerous bookholders are currently on the market that will hold a book open to a selected page in an upright or angled position. Typically, these bookholders have a transparent viewing window that contacts the selected pages, holding them flat for easy reading. In many instances, however, an individual using the bookholder is also performing other tasks (such as cooking). If the print is small or if the user has any eyesight deficiency, reading is difficult.

SUMMARY OF THE INVENTION

The present invention increases the readability of the printed material held in a bookholder, and therefore increases the utility of the bookholder, by incorporating a viewing window that provides magnification. The viewing window itself can be made to provide magnification, or a non-magnifying viewing window can be provided with means for mounting removable magnification elements to permit a user to select (and change) a desired level of magnification.

BRIEF DESCRIPTION OF THE DRAWING

A more complete understanding of the present invention can be had by reference to the following detailed description of the preferred embodiment when considered in conjunction with the accompanying drawings in which.

DESCRIPTION OF THE PREFERRED EMBODIMENT

Alternative embodiments will be described in which the bookholder of the present invention (a) incorporates a viewing window that is non-magnifying and adapted to mount separate magnification elements, and (b) a viewing window that provides magnification.

Figure 1:
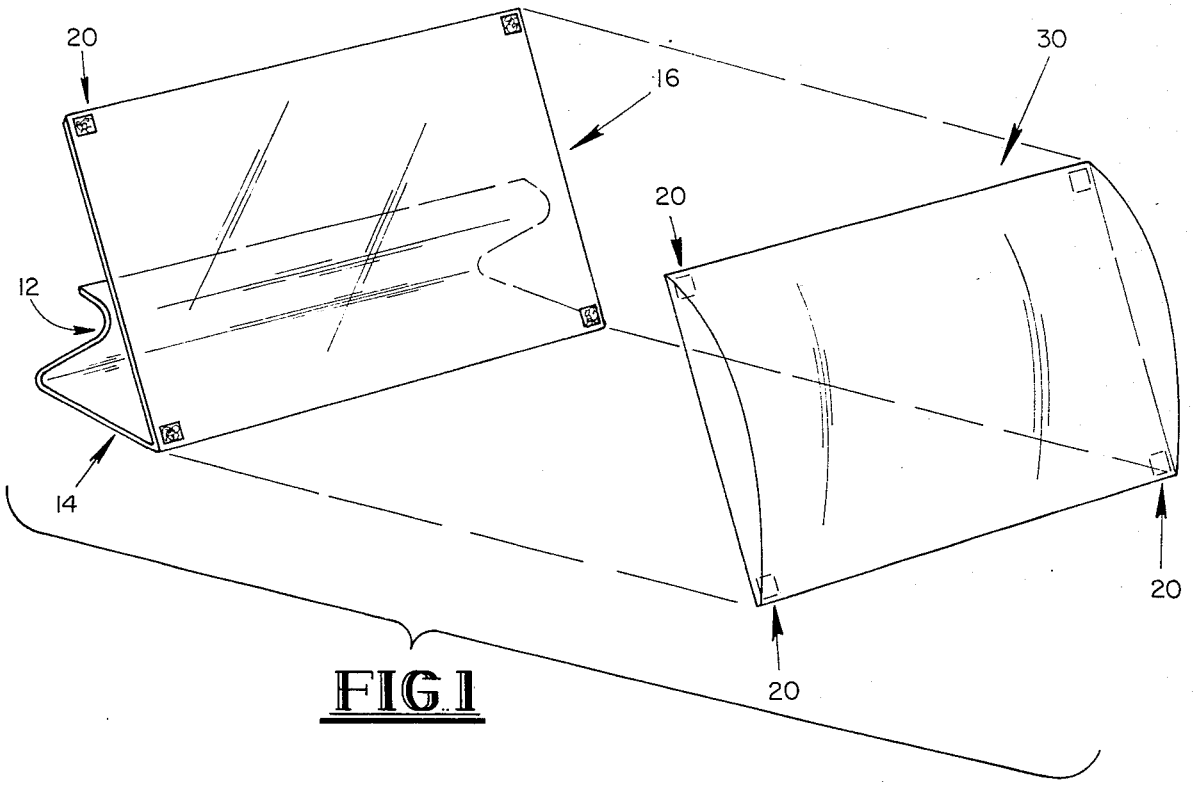
FIG. 1 is a perspective view showing a bookholder according to the present invention with removable magnifying elements.

Referring to FIG. 1, the bookholder 10 comprises a single, pre-formed sheet of clear, semi-rigid material (such as acrylic). The bookholder comprises a clamping portion 12, a flat standing surface 14, and a viewing window 16.

The bookholder is designed to receive a book open to a desired page in the channel formed by book clamp portion 12 and viewing window 16. The clamping portion 12 holds the book flat against the inside surface of viewing window 16 so that the pages can be viewed through the viewing window. Neither the shape of the bookholder 10, nor the material used to form the bookholder are critical to the present invention.

In this embodiment of the invention, magnification is provided by separate magnifying elements 30. Such a magnifying element can be mounted to the outer surface of viewing window 16 by any suitable means. For a preferred embodiment, corresponding velcro fasteners 20 are provided in the corners of both viewing window 16 and magnifying element 30. Once the magnifying element 30 is placed into contact with viewing window 16, the velcro fasteners hold the magnifying element in position such that the underlying printed material is magnified for easier reading.

Figure 2:
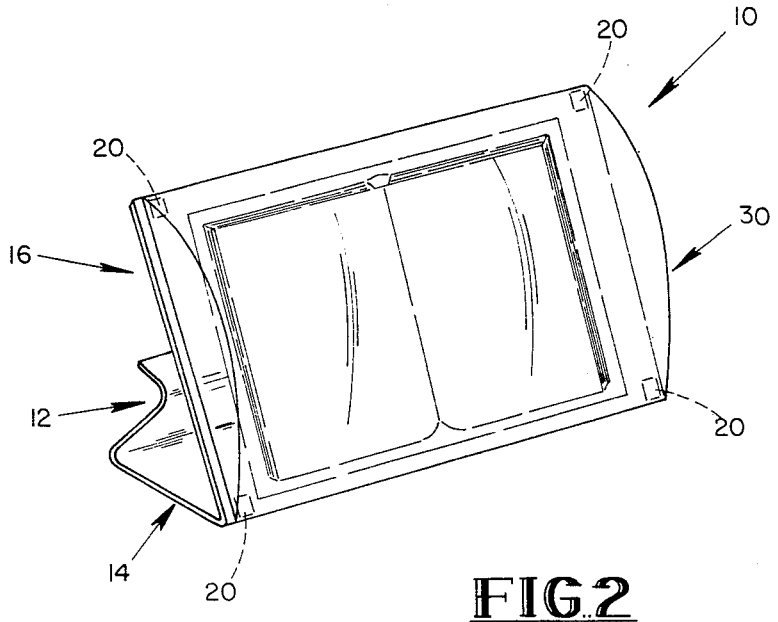
FIG. 2 is a perspective view showing the bookholder in which the viewing window provides magnification.

Referring to FIG. 2, an alternate embodiment of the present invention is shown in which viewing window 16 is formed to exhibit magnification.

I claim:

1. In a bookholder adapted to hold a book open to a preselected page into flat contact with an integral first viewing window such that substantially all the printed material on the preselected pages is exhibited through the viewing window for reading, the improvement comprising:

(a) A second viewing window of substantially the same dimensions as said first viewing window formed to magnify substantially all the underlying printed material, thereby facilitating readability and means removably mounting said secured window to said first window.

* * * * *